US006405472B1

(12) United States Patent
Dojcsak

(10) Patent No.: US 6,405,472 B1
(45) Date of Patent: Jun. 18, 2002

(54) GUN LOCK SAFETY DEVICE

(76) Inventor: Endre Dojcsak, 152 E. 21st St., Cape Coral, FL (US) 33990

( * ) Notice: Subject to any disclaimer, the term of this patent is extended or adjusted under 35 U.S.C. 154(b) by 0 days.

(21) Appl. No.: 09/798,067

(22) Filed: Mar. 5, 2001

(51) Int. Cl.[7] ..... F41C 27/00
(52) U.S. Cl. ..... 42/70.11; 42/70.01
(58) Field of Search ..... 42/70.11, 70.01

(56) References Cited

U.S. PATENT DOCUMENTS

| | | | | | |
|---|---|---|---|---|---|
| 3,768,189 | A | * | 10/1973 | Goodrich | 42/70.11 |
| 5,048,211 | A | * | 9/1991 | Hepp | 42/70.11 |
| 5,450,685 | A | * | 9/1995 | Peterson | 42/70.11 |
| 5,918,403 | A | * | 7/1999 | Lurz, Jr. et al. | 42/70.11 |
| 6,202,336 | B1 | * | 3/2001 | Audino | 42/70.11 |

* cited by examiner

*Primary Examiner*—J. Woodrow Eldred

(57) ABSTRACT

The invention pertains to a gunlock safety device which is inserted into the barrel of a firearm. The gunlock includes an expander component consisting of several sections which are expanded inside the barrel to make frictional contact with the interior wall of the barrel. The several sections of the expander are expanded by a front and a rear wedge, as seen from the muzzle end of the firearm, which have conical ends. The expander has an inverted conical recess at each of its ends. The rear wedge has a rod extending into the breech of the firearm to thereby prevent any ammunition from being introduced into the barrel. The rear wedge has at its other end a shaft extending therefrom toward the front wedge. The shaft has a threaded end which will engage a threaded recess in the end of the front wedge. The shaft extends through the expander and when the front wedge is threaded onto the threaded and of the shaft, the two wedges approach each other and cause the expander to expand and make frictional contact with the inner circular wall of the barrel. Special keys at an end of a tool prevent an operation of the front wedge to thereby remove the same from the inside of the barrel.

17 Claims, 5 Drawing Sheets

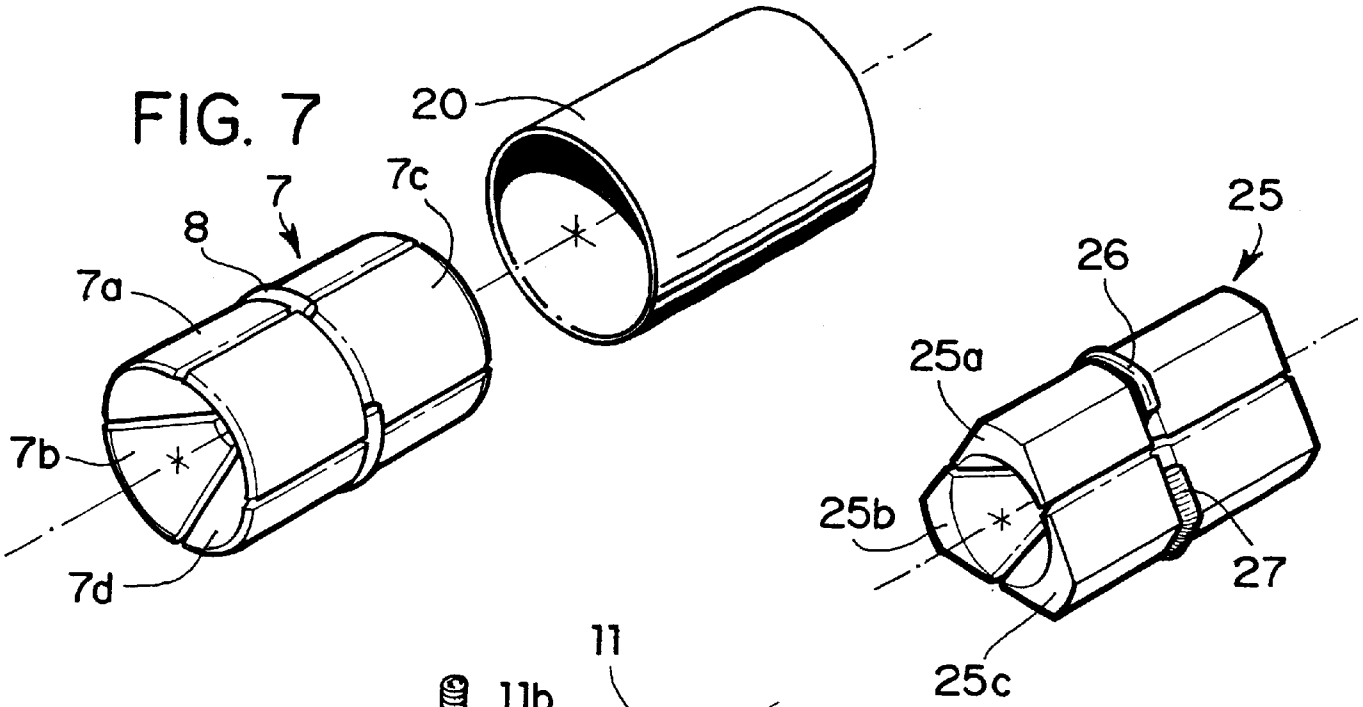
FIG. 7
FIG. 8
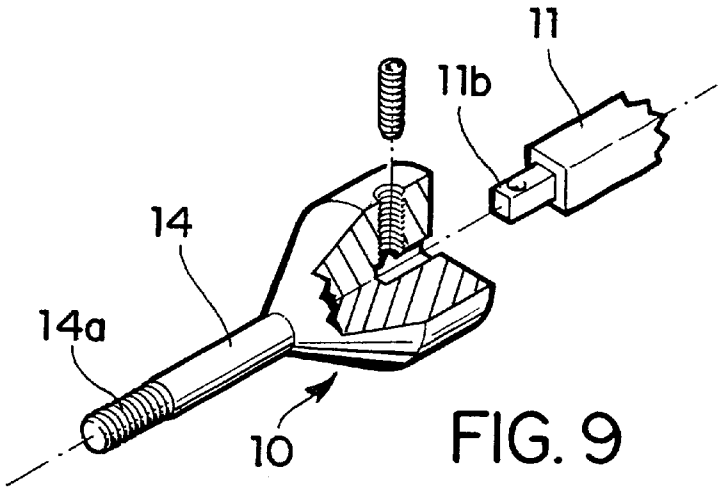
FIG. 9

GUN LOCK SAFETY DEVICE

CROSS REFERENCE TO RELATED APPLICATION none

STATEMENT REGARDING FED SPONSORED R&D none

REFERENCE TO MICROFICHE APPENDIX none

BACKGROUND OF THE INVENTION

The invention pertains to a gun lock safety device. The safe use of guns, nowadays, is utmost in the minds of many in the world population. This invention not only pertains to the safe use of guns but also to the non-use of guns. It is well known that many accidents happen because of accidental shootings. This happens through the unauthorized use of a gun that is loaded, where a cartridge is in the gun either in the barrel or in the cylinder of a gun. Children are known to have had access to a gun or find the gun hidden in a so-called hiding place. It is possible that a gun is located in one place while the ammunition or the cartridges are located in another place with the hope that the two will not be connected with each other. It is known that guns are stolen for a particular purpose or to be pawned at a pawn shop. In all of the events above, the guns can be used for a purpose or to create shooting accidents because of inferior knowledge of the gun or unsafe handling of the gun.

Many devices are known that prevent an accidental firing of the gun or a premeditated use of a gun. These devices are known as trigger locks. These devices are inserted between the trigger guard surrounding the trigger of the gun and the stock material of the gun. There is a locking mechanism associated with the trigger locking device that locks the device into place. This device prevents the trigger from being pulled or squeezed to prevent the firing bolt from hitting a cartridge that happens to be located in the firing chamber of the barrel. A gun is dangerous whenever a cartridge is in the firing chamber or in the barrel. While any of the trigger locks do prevent accidental firing of any gun or prevent a firing altogether, especially when children are involved, the trigger locks are not that safe because by nature they must be small to fit around the trigger and between the guard surrounding the trigger and the stock of the gun. Therefore, the locking device, with some more or less force could be broken out from where it is locked in place. Government safety tests have determined that all but one of 32 models of gun locks could be opened without the key, some just by striking them hard. It has been found that one could open the trigger locks with a paper clip, a pair of scissors or tweezers, or they could be opened just by whacking them on a table. The Consumer Product Commission is planning to urge the gunlock industry to develop standards to make sure that gun locks work as advertised. Another disadvantage of the above described devices is that they must be supplied in many different sizes because the dimensions are different between so many different guns. Also the dimensions are different between pistols and revolvers. This fact adds greatly to the expense of obtaining differently sized trigger locks, especially when a gun collection is involved because the guns in that collection are of different sizes.

SUMMARY AND OBJECTS OF THE INVENTION

It is an object of the invention to produce a gun lock that fits many different firearms including rifles, shot guns, sub-machine guns, pistols and revolvers. The gun, used in its generic term to include all firearms, has the lock so designed that it can not be removed from the gun once it is installed in the gun unless a special tool or key is being used to remove the lock. The lock cannot be removed from the gun without the use of a key. The lock is installed in the barrel of the gun and therefore, cannot be destroyed or broken out. As a matter of fact the lock cannot be seen from the outside by casually inspecting the gun unless someone looks into the barrel. Another feature of the gun lock of the invention is that after the lock is installed, no cartridge can be placed into the firing chamber or the barrel of the gun including the revolving cylinder of a revolver. Other advantages of the gun lock of the invention will become apparent as the description continues below.

BRIEF DESCRIPTION OF THE DRAWINGS

FIG. 7 shows a tool assembly for activating the expander;

FIG. 8 shows a different tool for activating the expander;

FIG. 9 shows still another tool for activating the expander.

DETAILED DESCRIPTION OF THE INVENTION

Figure 1:
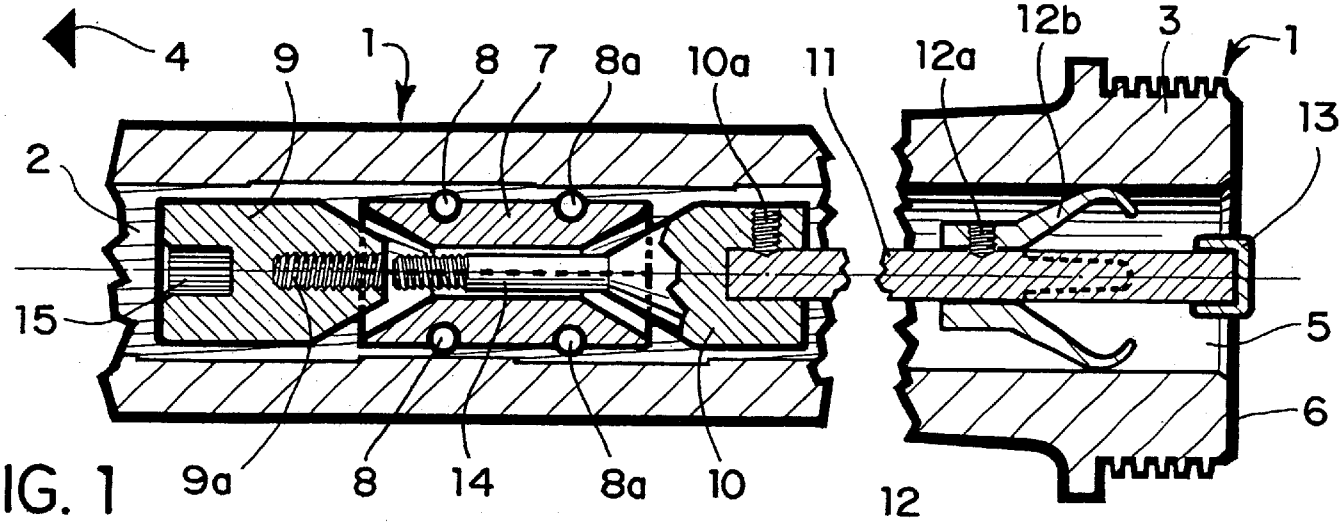
FIG. 1 Shows the gunlock device within a barrel prior to expanding.

FIG. 1 shows the barrel 1 of a rifle, a shotgun, a pistol, a revolver or a sub-machine gun etc. The gunlock device can be installed in any of the above mentioned weapons without any major alterations. It is merely up to the user to use different sizes of the same device. The description will therefore continue based on all sizes. The barrel 1 shows the interior rifling at 2, although some weapons may not have such a rifling and it is immaterial to the invention whether there is a rifling or not. The breech end of the rifle is indicated at 3 while the muzzle end is indicated by the arrows 4. The orientation of the muzzle at 4 and the breech end is important to the invention. It is noted that the ammunition chamber has a smooth interior as is indicated at 5. The firing bolt (not shown) closes gas tight at the end 6. When the gun is to be secured against use, the expander component 7 is placed inside the barrel. The expander component 7 consists of several sections which be explained below. The several sections are held together by O-rings 8 and 8*a* of an elastic nature, although one O-ring will suffice as will be explained below. This will render the expander component in a relaxed state. The expander component 7 has two interior inverted cone-shaped end cavities which are connected by an interior passage through the expander component 7. As seen from the muzzle end of the gun, there is a front wedge 9 and a rear wedge 10. both wedges 9 and

10 are cone-shaped at one of their ends to compliment the interior inverted cone-shaped cavities of the expander component. The rear wedge 10 has a rod 11 attached thereto by way of a set screw 10*a* passing through the wedge 10. The other end or forward end of the rear wedge 10 has a shaft 14 extending therefrom which has at one of its end a thread applied thereto. The front wedge 9 has, at an end facing into the barrel 1, a threaded interior section provided therein, while at the other end of the wedge 9, facing forward has a an interior splined or fluted section provided therein.

It now becomes clear that when the front wedge 9 is threaded onto the threaded end 14*a* of the shaft 14, which is fastened to the rear wedge 10, the two wedges 9 and 10 will approach each other while the cone-shaped ends of both wedges will ride up on the inverted cone-shaped interiors of the expander component 7 to thereby drive the individual sections of the expander component 7 outwardly until the sections will make contact with the interior of the barrel wall, such as the rifling 2. This will securely leave the expander component within the barrel 1. This can only be accomplished from the muzzle end because the other end of the rear component is not available because of the presence of the rod 11 which will extend into the firing chamber of the gun. This way no cartridge can be present of placed into the barrel 1. This secures the gun against any accidental or deliberate firing. The end of the rod 11 which is placed into the firing chamber has a protective plastic cap 13 placed thereon to avoid any damage to the elements located in that area of the gun. In case that this gunlock device is placed into a gun having a long barrel 1, a protective device 12 is placed at an intermediate position on the shaft 11. The device 12 is secured to the shaft 11 by a set screw 12*a*. The protective device 12 has spring-like fingers 12*b* placed thereon which will lightly touch the interior of the barrel or the rifling without damaging the same. In a long barrel, this protective device will prevent the shaft 11 from flopping around within the barrel 1 when the gun is being handled.

Figure 2:
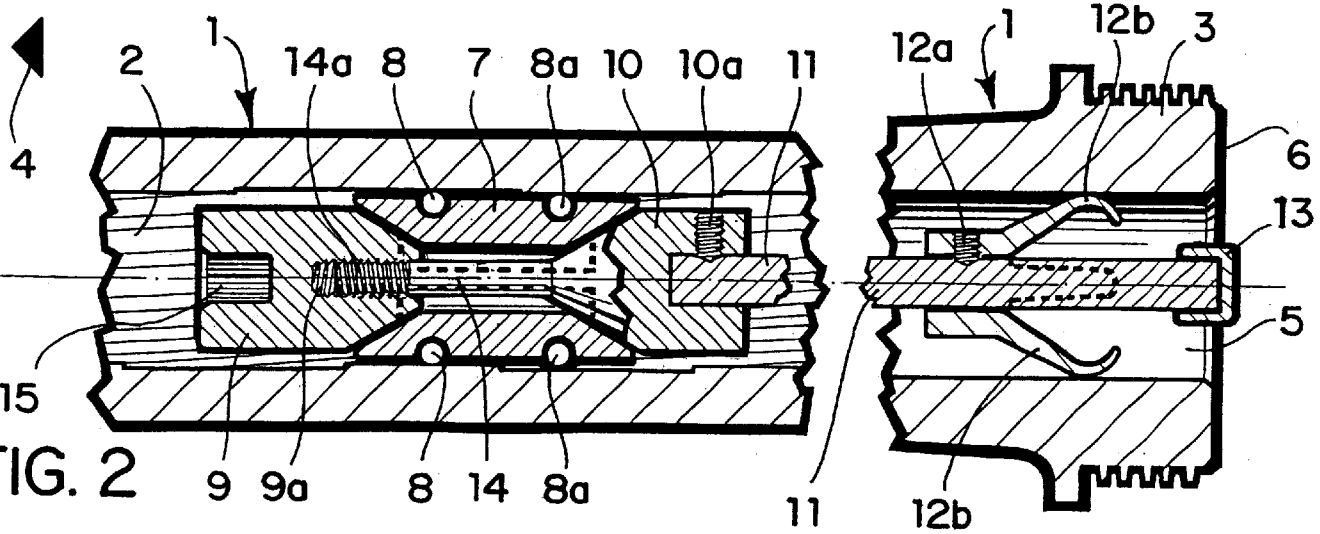
FIG. 2 shows the gunlock device within a barrel after having expanded.

Turning now to FIG. 2, there is shown the same layout of elements as was shown in FIG. 1 including the same reference characters as were applied in FIG. 1. The only difference between the two Figs. is that the expander component 7 of FIG. 2 has been engaged with the interior of the barrel 1. This makes it clear now that both wedges 9 and 10 have been pulled into the expander component whereby the individual sections of the expander component-have been driven outwardly until making wedging contact with the interior of the barrel 1 or the rifling 2 of the barrel 1.

Figures 3, 3A, 3B, 3C:
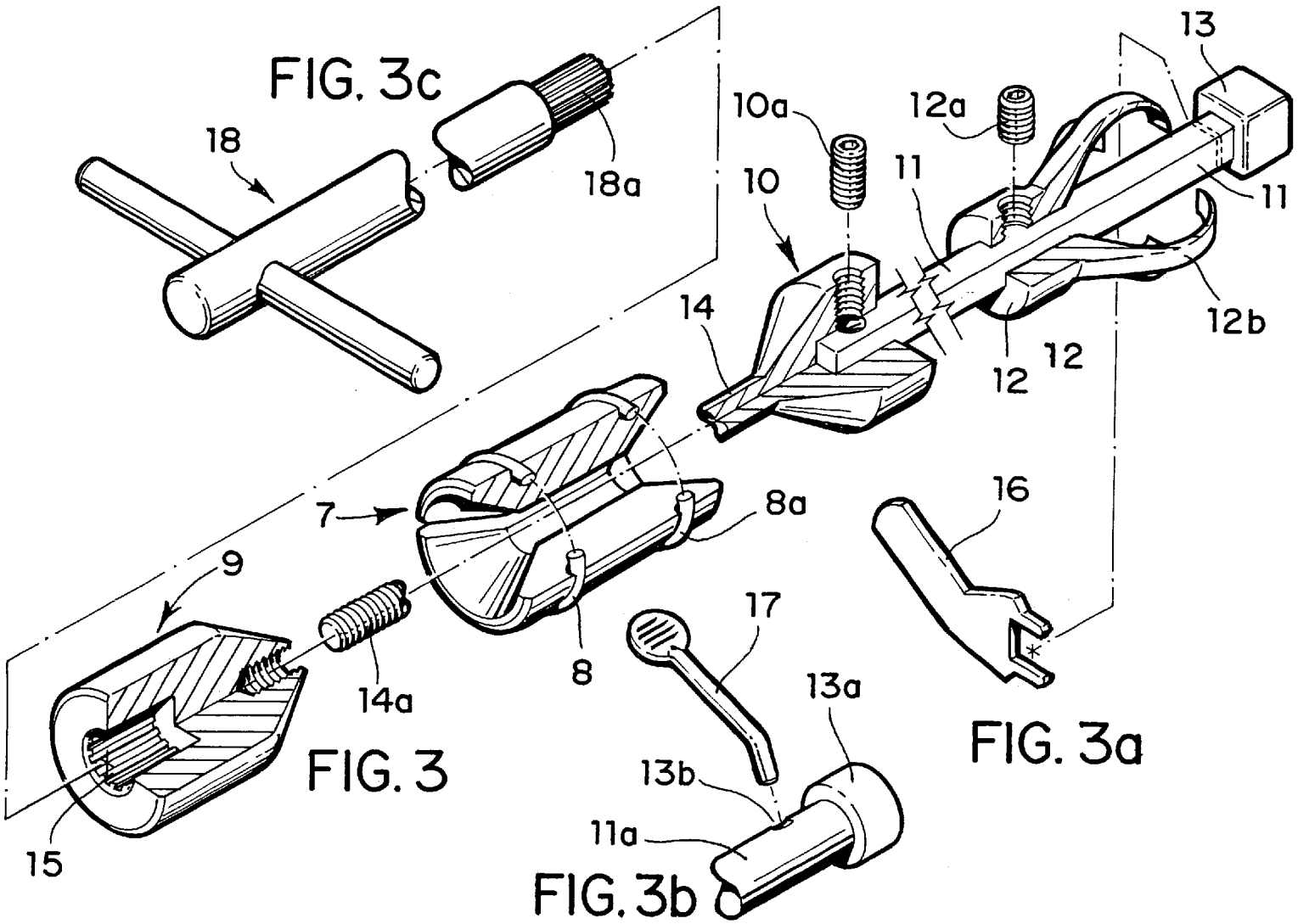
FIG. 3 illustrates the individual elements of the gunlock device.
FIGS. 3A to 3C show tools to be used during the installation of the gunlock.

Turning now to FIG. 3, there is shown a distended view of the various elements of FIGS. 1 and 2. The same reference characters have been applied to the same elements as was done in FIGS. 1 and 2. Attention is directed to the rod 11 which normally is located within the barrel 1. In this view the rod is shown as being square but the shaft 11 could equally be round. When the expander component is applied to a short barrel 1, the barrel protector 12 could easily be omitted since the rod 11 would be rigid enough not to cause any damage. It is also clear that the rod 11 could also be shorter in a short barrel gun such as a pistol or a revolver. FIG. 3*a* shows an open jaw wrench which could be applied to the square rod 11 when it appears in the open part of the firing or cartridge chamber. The use of this wrench aids in holding the rear shaft 10 from turning when the front wedge 9 is turned or rotated so that the two wedges 9 and 10 can approach each other to initiate a wedging operation. In the event that the rod 11 is round, the tool of FIG. 3*b* can be used whereby the rod 11 is prevented from turning when the tool pin 17 is placed into the hole 13*b*.

Figures 4, 5:
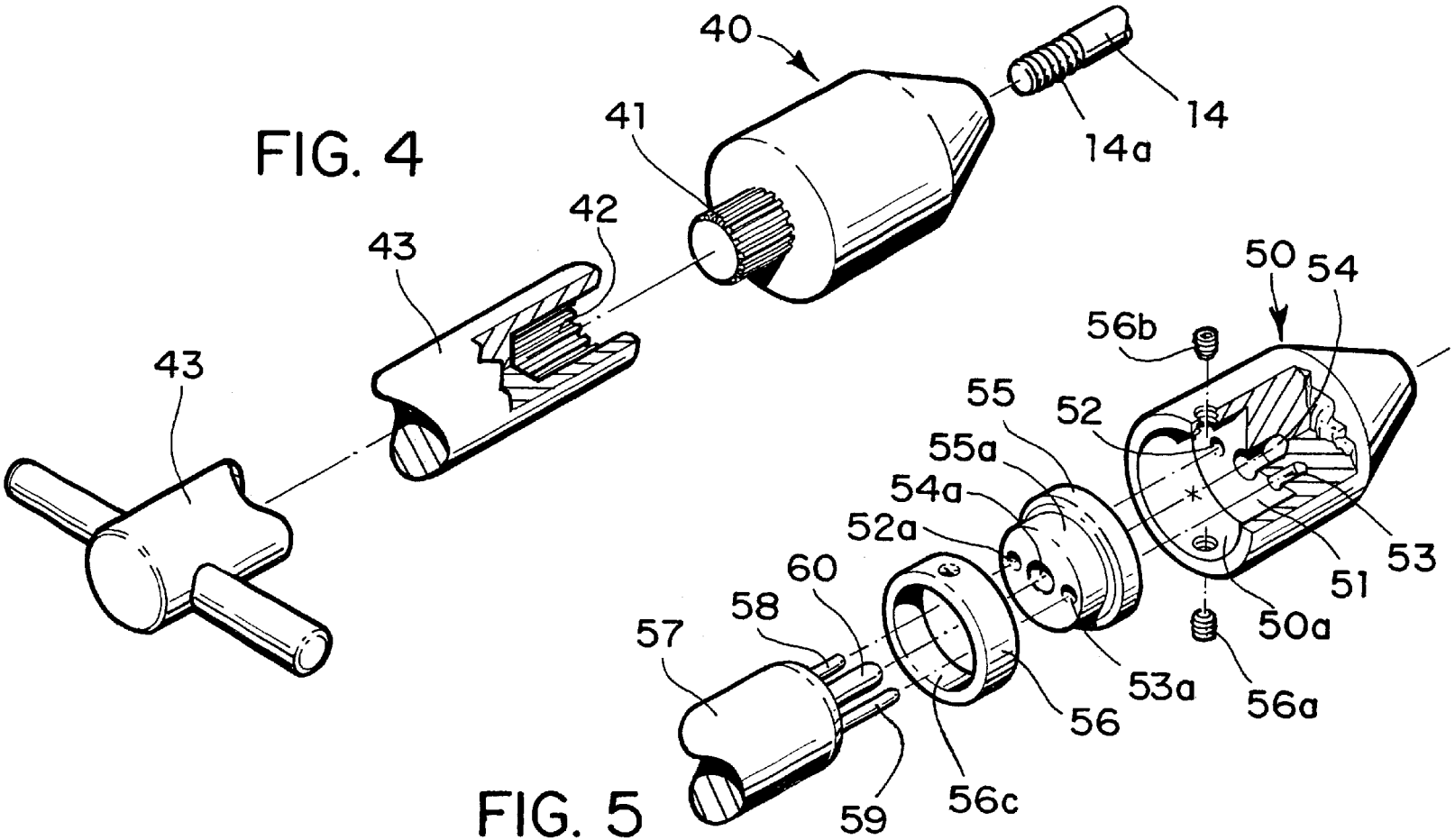
FIG. 4 shows a circular expander with a protective sleeve.
FIG. 5 illustrates a triangular expander.

The tool shown in FIG. 3*c* will be used to turn the front wedge so that it can threaded onto the threaded onto the treaded end 14*a* of the shaft 14. It is desirable that no unauthorized deactivation of the front wedge 9 and thereby the deactivation of the expander component can be undertaken to thereby prevent any unauthorized use of the gun or the firearm. To this end, the tool 18 of FIG. 3*c* has at one end thereof of a fluted extension 18*a* which is so designed to match the interior of the fluted recess 15 in the front wedge 9. This way, only this tool can be used to take the expander component 7 out of the barrel 1 of the gun. Attention is directed to FIG. 4 showing a reversal of the elements of FIG. 3*c*. It is quite possible that a bladed tool such as screw driver can be inserted into the fluted recess 15 of the front wedge 9 to thereby defeat the intention of unauthorized use of the firearm. In FIG. 4, the extension 41 of the wedge 40 has the fluted shape thereon, while the tool 43 has the fluted recess therein. Thereby, to deactivate the wedge 40 by turning the same, a more special tool is required.

FIG. 5 is a more complicated tool arrangement, which may be desirable under some circumstances. To this end, the front wedge 50 has an interior recess or bore 50*a* therein which ends in a circular shelf 51. The shelf 51 has three bores 52, 53, and 54 therein. The bore 54 is a pilot or guide hole, while the bores 52 and 53 are offset from the pilot hole but at unequal distances therefrom. A spinner or freely rotating ring 55 is inserted into the recess 50*a* and the ring will seat on the shelf 51. The ring 55 has three through bores therein which are placed at the same dimension and orientation as the three holes 52, 53 and 54 in the shelf 51. Finally, the arresting ring 56 is placed within the recess 50*a*. The interior 56*c* of ring 56 will thereby freely embrace the circular hub of the spinner or ring 55. Once the arresting ring 56 is fastened within the recess 50*a* of the front wedge 50 by way the set screws 56*a* and 56*b*, the spinner ring 55 cannot escape therefrom anymore but can freely rotate in the recess 50*a*. That why it is called a spinner. The end 57 of the tool has three protruding pins 58, 58 and 59 extending therefrom. The center pin 60 represents the pilot pin to enter the holes 54*a* in the ring 55 and the hole 54 in the shelf 51 of the wedge 50. The other two pins 58 and 59 are placed again in the same manner and orientation as were the through bores 52*a* and 53*a* and the holes 52 and 53 in the shelf 51 of the wedge 50. Assuming that the expander component 7 is in a wedging position, meaning, that the gunlock is in a locked position, and it is desirable to remove the gunlock from the firearm, the tool end 57 with the extending pins 58, 59 and 60 is first inserted into the freely spinning ring 55. By rotating the tool, the pins 58, 59 and 60 first have to find the corresponding holes 52*a*, 53*a* and 54*a* by trial until the pins have penetrated the through bores. Thereafter, the tool 57 has to be further rotated until the pins 58, 59 and 60 find the holes 52, 53 and 54 on the shelf 51, again by trial. After the above trials, a connection has been made between the tool 57 and the wedge 50 which can now be rotated to remove the wedging effect and the gun lock can now be removed from the inside of the gun barrel 1. It is believed that this tool arrangement, as described with reference to FIG. 5, would almost be tamperproof against an unauthorized use of the firearm.

Figure 6:
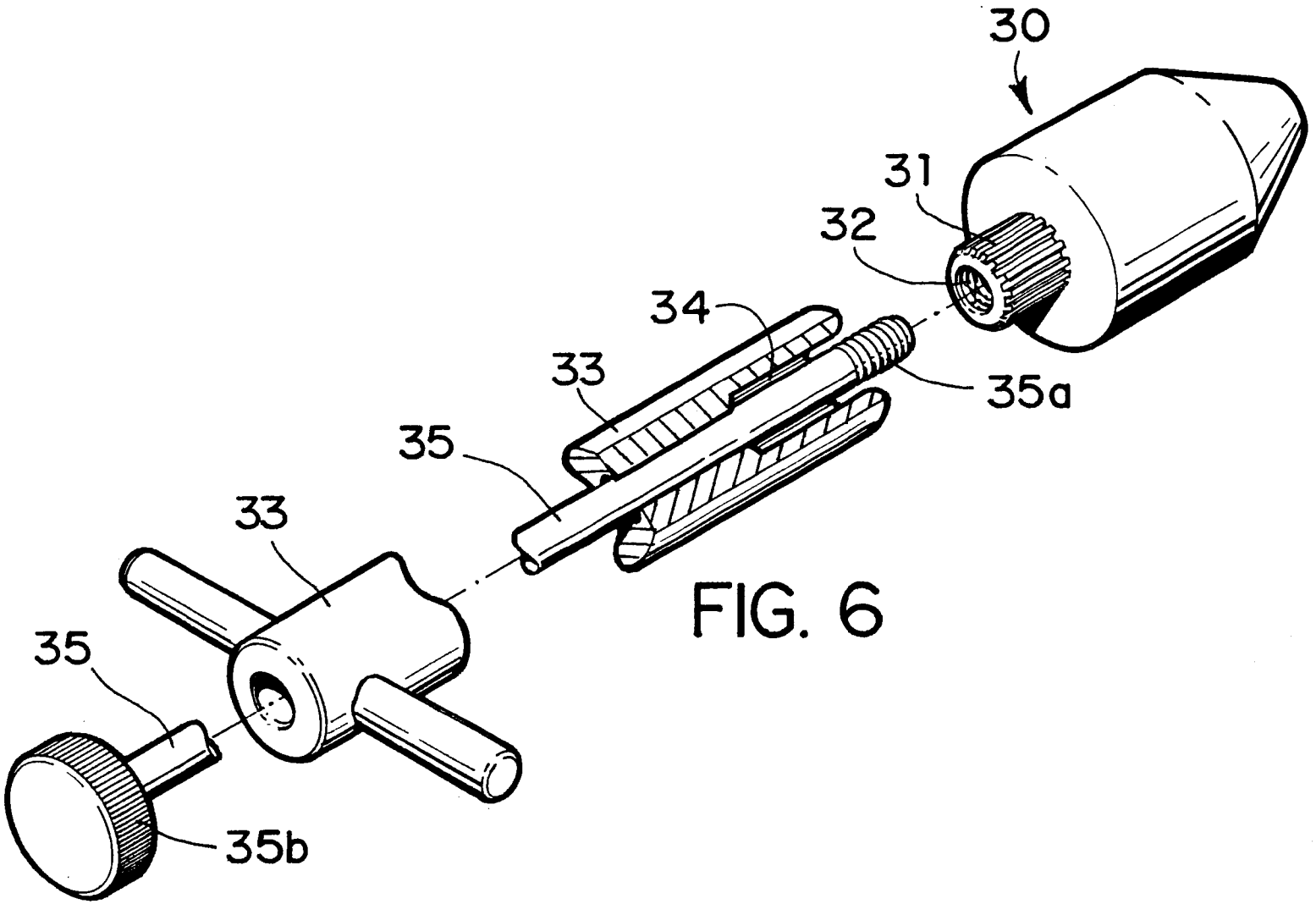
FIG. 6 illustrates a different manner of connecting elements.

FIG. 6 shows yet another tool to be used in installing or removing the gunlock from inside of a barrel of a firearm. The front wedge 30 again has the fluted extension 31 as was shown at 41 in FIG. 4. However, the fluted extension 31 also a threaded recess 32 therein. The tool 33 consists of two parts, that is an outer part 33 and an inner part 35. The outer part 34 has a fluted recess therein comparable to the fluted extension 31 on the front wedge 30. The inner part, formed as a shaft 35 has a threaded end 35*a* and a knurled knob 35*b* at the other end. In operation, when installing the gunlock, the shaft 35 with its threaded end 35*a* is first screwed into the threaded recess 32 of the front wedge 30, while the shaft 35 is freely rotating within the tool 33. It is quite possible that the shaft 35 may now be used to further rotate the front wedge to start and/or finish the wedging action of the expander component 7 because everything is right-hand threaded. But the shaft 35 cannot be used to remove the expander component 7 from barrel 1 of the firearm because the shaft 35 would unscrew itself from the front wedge 30 because of left-hand turns. This is when the other part 33 of the tool comes into play. At this point the interior fluted recess 34 has to engage the exterior fluted extension 31 of the front wedge in order to establish a rigid connection.

Turning now to FIG. 7, there is shown an expander component 7 by itself. It consists of four sections 7*a*, 7*b*, 7*c* and 7*d* while in FIGS. 1 and 2 only two sections are shown. This arrangement will facilitate a better wedging action in larger inner diameter of barrels, such as in shotguns, for example. Also shown in FIG. 7 is a protective elastic sleeve 20 which, when slipped over the expander component, will protect the interior wall or rifling of the barrel when the expander component 7 is in place. It is quite possible, that when the elastic sleeve is being used, the O-rings 8 and 8*a* may be omitted altogether. Also in FIG. 8 it is noted that only one O-ring is being used, while FIGS. 1 and 2 show the use of two elastic rings. The use of one or two O-rings depends largely on the length of the barrel and the length of the expander component being used.

FIG. 8 shows an expander component in a triangular shape rather than in a circular shape in previous Figs. The triangular expander component consists of three sections 25*a*, 25*b* and 25*c*. The use of a triangular expander component will lessen any surface contact the expander makes with the interior surface of the barrel. FIG. 8 also shows the elastic O-ring 26 which could be a rubber or a neoprene material. Also, there is shown a coil spring ring 27 which could replace the O-ring 26.

Finally, turning to FIG. 9, there is shown a different manner of connecting and fastening the extending rod 14 into the rear wedge 10. as was shown in FIG. 3, the rod was connected to the rear wedge 10 by merely extending the same into a depression in the wedge 10 and fastening the same by the use of a set screw 10*a*. In FIG. 9, the front of the rod 11 is first decreased in its cross--sectional size as at 11*b* and then is fastened within the rear wedge 10 by way of the set screw 10*a*.

CONCLUSION

From all of the above it can now be seen that a gunlock safety device has been created which can quickly be installed in the barrel of a firearm. Once it is installed, it cannot be seen by a casual observance and it is difficult to remove unless special tools or keys are being used. However, when using the special tools, the gunlock can quickly be removed. The gunlock safety device can be used in all firearms without any further modifications. The only obstacle would be the size of the inner diameter of the barrel. Different sizes for particular firearms can be provided. Another controlling factor is the length of the barrel of the firearm. In this case, the rod extending into the barrel toward the breech or firing chamber can be supplied longer or shorter. Another advantage of the gunlock of the invention resides in the fact that the rod itself extends into the breech or fire chamber of the gun whereby no cartridges or ammunition can be placed therein. In a revolver. the rod can be extended into an empty bore of the cylinder, whereby the cylinder cannot be rotated to bring bullets in the line of the firing pin. It is also possible to leave the cylinder in an out of way or loading position, whereby the cylinder cannot be swung into position even though bullets may in the cylinder but cannot be brought into a firing position. It is also clear that the inside wall of the barrel of the firearm, whether smooth or rifled is protected at all times against any damage because of various precautions having been taken as was explained above as the description proceeded.

What I claim is:

1. A gunlock safety device for a firearm having a barrel, said barrel having an inside circular wall, said gunlock device includes an expander component adapted to be placed within said barrel, means for expanding said expander component so as to make frictional contact with said inside circular wall, a rod extending from said means for expanding into a breech of said firearm to prevent any bullets from being placed into said breech, said expander component has two ends and wherein each of said ends has inverted conically-shaped recesses therein.

2. The gunlock safety device of claim 1, wherein said expander component consists of two separate sections.

3. The gunlock safety device of claim 1, wherein said expander component consists of three separate sections.

4. The gunlock safety device of claim 1, wherein said expander component consists of four separate sections.

5. The gunlock safety device of claim 1, wherein said expander component is of a circular cross section.

6. The gunlock safety device of claim 1, wherein said expander component is of a triangular cross section.

7. The gunlock safety device of claim 1, wherein said expander component is surrounded by at least one elastic ring to keep said expander component in a collapsed and a compact configuration when not in use or not being expanded.

8. The gunlock component of claim 1, wherein said expander component is surrounded by an elastic sleeve to keep said expander component in a collapsed and a compact configuration when not in use or not being expanded but to protect said inside circular wall of said barrel from being damaged when said expander component is in an expanded state.

9. A gunlock safety device for a firearm having a barrel, said barrel having an inside circular wall, said gunlock safety device includes an expander component adapted to be placed within said barrel, means for expanding said expander: component to make frictional contact with said inside circular wall, a rod extending from said means for expanding into a breech of said firearm to prevent bullets from being placed into said breech, wherein said means for expanding includes a front wedge and a rear wedge as seen from a muzzle end of said firearm and wherein both of said wedges have conically-shaped shaped ends, each of said ends facing said expander component.

10. The gunlock safety device of claim 1, wherein said expander component includes a rear wedge and a front wedge and wherein said rear wedge has an extension shaft facing said expander component and having a threaded end, and wherein said front wedge has a threaded recess therein also facing said expander component.

11. The gunlock safety device of claim 10 including means for turning said front wedge relative to said rear wedge while threading said threaded recess of said front wedge onto said threaded end of said rear wedge whereby said front wedge approaches said rear wedge and said conically ends of each of said wedges will move into said inverted conically shaped recesses to thereby expand said expander component.

12. The gunlock safety device of claim 11, wherein said means for turning includes key means on a tool.

13. The gunlock safety device of claim 12, wherein said key means on said tool includes a fluted extension on an end of said tool and said front wedge on another end includes a fluted recess, said fluted extension matching said fluted recess when inserted into said fluted recess.

14. The gunlock safety device of claim 12, wherein said key means on said tool means includes a fluted extension on another end of said front wedge and an end of said tool includes a fluted recess, said fluted extension matching said fluted recess when inserted into said recess.

15. The gunlock safety device of claim 12 including pins at an end of said tool means, said pins are eccentrically offset from a center of said tool and from each other, said front wedge having at its other end bores therein, said bores are eccentrically offset from a center of said wedge end and from each other, said pins and said bores will match each other when said pins are inserted into said bores.

16. The gunlock safety device of claim 15 including a freely spinning disc inserted into a recess of said other end of said front wedge, said freely spinning disc having through bores therein, said through bores are eccentrically offset from a center of said disc and from each other, whereby said pins on said end of said tool and said through bores on said disc will match each other when said pins are inserted into said bores in said front wedge.

17. The gunlock safety device of claim 12 including tool means for preventing said rod from turning when said key means are turning said front wedge.

* * * * *